US005299375A

United States Patent [19]

Thummel et al.

[11] Patent Number: 5,299,375

[45] Date of Patent: Apr. 5, 1994

[54] LASER DIODE ALIGNMENT MECHANISM

[75] Inventors: Heinz H. Thummel, Salinas; Dave E. Doggett, Bolder Creek; Gary G. Love, Monterey, all of Calif.

[73] Assignee: Laser Devices, Inc., Monterey, Calif.

[21] Appl. No.: 50,976

[22] Filed: Apr. 21, 1993

Related U.S. Application Data

[63] Continuation of Ser. No. 645,466, Jan. 24, 1991, abandoned.

[51] Int. Cl.[5] ..... F41G 1/35

[52] U.S. Cl. ..... 42/103; 362/110

[58] Field of Search ..... 42/103; 33/241; 362/110, 113, 114

[56] References Cited

U.S. PATENT DOCUMENTS

| | | | |
|---|---|---|---|
| 867,552 | 10/1907 | Bradford et al. | 301/87 |
| 2,075,467 | 3/1937 | Quesada | 123/90.52 |
| 2,485,280 | 10/1949 | Grace | 254/98 |
| 3,227,199 | 1/1966 | Mount | 411/307 |
| 3,402,613 | 9/1968 | Neusel et al. | 33/814 |
| 3,633,285 | 1/1972 | Sensney | 42/103 |
| 3,813,790 | 6/1974 | Kaltmann | 33/241 |
| 4,281,993 | 8/1981 | Shaw | 102/103 |
| 4,313,272 | 2/1982 | Matthews | 102/103 |
| 4,662,806 | 5/1987 | Reed | 411/2 |
| 4,781,351 | 11/1988 | Parapetti | 248/291 |
| 5,033,219 | 7/1991 | Johnson et al. | 42/103 |

*Primary Examiner*—Stephen M. Johnson

*Attorney, Agent, or Firm*—Poms, Smith, Lande & Rose

[57] ABSTRACT

An adjustable platform in two orthogonal directions for the angular alignment of the axis of a solid state laser diode. The platform carries the laser diode at its center and is attached to a base plate at three points. Two attachment points are adjustable and provide for fine angular adjustments by changing the separation of the base plate and platform. The third attachment point provides for a fixed separation between base plate and platform and also preloads the tension on the adjustable attachments. The geometric relationship of the attachment points provides for the orthogonality and independence of the angular adjustments.

51 Claims, 3 Drawing Sheets

LASER DIODE ALIGNMENT MECHANISM

This application is a continuation of now abandoned application Ser. No. 07/645,466, filed Jan. 24, 1991.

BACKGROUND OF THE INVENTION

1. Field of the Invention

This invention generally relates to the field of optical alignment apparatus and, more particularly, to an apparatus for inducing fine adjustments to the alignment of a light beam along a desired axis.

2. Description of the Prior Art

In many applications where an optical beam is used to project a spot for the purpose of establishing a reference path or target point, the axis of the optical beam must be aligned with respect to another component or reference. By way of example, in applications employing a laser as a sighting device for a firearm, the laser spot formed by projecting the laser beam onto a target provides an indication of the impact point of the firearm projectile on that target. In such applications the laser is commonly mounted directly onto the firearm. To achieve coincidence between the laser spot and the projectile impact point, the laser beam must normally be aligned with respect to one or more points along the slightly parabolic trajectory of the projectile. To achieve this alignment, the laser beam itself must usually be precisely oriented with respect to the firearm, which establishes the trajectory of the projectile. This alignment of the laser with respect to the firearm is commonly achieved either by mechanisms that deflect the laser beam along a desired path, or by mechanisms that physically reorient the axis of the entire structure of the laser.

Typical mechanisms for providing fine adjustment to the axis of the laser structure are usually bulky in comparison to the size of the laser or lack the necessary degree of sensitivity for making sufficiently fine adjustments in the orientation of the laser housing. Beam deflection devices that achieve realignment of the laser beam by reflection of the beam are commonly more compact, but are usually costly due to the high cost of precision optical-quality components and may be sensitive to shock and vibration. In some applications both the laser and the alignment mechanism can be subjected to high levels of shock and vibration. Where a laser is used as an aiming device for a handgun or other firearm, the laser and alignment mechanism are normally subjected to considerable shock and vibration when the firearm is discharged.

Accordingly, there exists a need for a compact mechanism that maintains a stable alignment in the presence of high levels of shock and vibration, but is also compact and capable of creating minute changes in beam orientation.

SUMMARY OF THE INVENTION

It is an object of this invention to provide a compact and stable means of aligning the axis of a laser structure.

Another object of this invention is to provide an alignment means with a fine adjustment capability for two orthogonal axes which may be selected as horizontal and vertical.

In one aspect of the present invention, the laser alignment device consists of two plates mutually joined at three attachment points in such a way that adjustment of either of two adjustable attachment points provides for the inclination of one plate, a platform with an attached laser, relative to the other plate, a base plate. In the preferred embodiment the three attachment points lie on a circle centered on and in the plane perpendicular to the axis of a beam generated by the laser attached to the platform plate. The two adjustable attachment points are disposed at opposite ends of a common diameter of the circle and control the separation of the platform and the base plate at these two points. Two machine screws, each having a different thread pitch for the portion of the screw that engages the base plate and for the portion of the screw that engages the platform plate, are used to secure these two adjustable attachment points. As these attachment screws are rotated the variable separation of the base plate and platform plate is accomplished by the differential threading action of the two thread rates. In the preferred embodiment the third attachment point is a fixed attachment on the circle containing the two adjustable attachment points and equidistant from the two adjustable attachment points. This fixed attachment is installed in such a way as to cause a normal from the plane of the platform to be at a small angle with respect to the normal from the plane of the base plate. Such installation in the preferred embodiment is accomplished by drilling and tapping a hole in either the base plate or the platform at a small angle to the normal while the hole in the respective plate is drilled along a normal to the plane of that plate. The fixed attachment is then secured by a machine screw having a constant thread pitch in both the base plate and the platform plate to provide a fixed separation between the base plate and the platform plate.

In another aspect of the invention, an interior angle formed between two lines drawn one from each of the adjustable attachments to the fixed attachment is preferably a right angle thus assuring that the two adjustments are orthogonal. As each adjustable attachment screw is separately adjusted the platform plate pivots about the other adjustable attachment point and the fixed attachment point with the axis of rotation substantially in the plane of the platform. The third attachment point contains a non-adjustable or fixed member which provides both a fixed separation and a two dimensional pivot to allow inclination of the platform by the adjustable attachment points. With the fixed attachment installed prior to installation of the adjustable attachments, the base plate and platform are inclined at a small angle relative to each other and, in this aspect of the invention, with the base plate and platform closer at their centers than at the fixed attachment point. Upon installation of the adjustable attachments the action of the differential thread causes the base plate and platform to separate at the corresponding two points of attachment. The spreading action strains the tilted axis of the fixed attachment and causes it to tilt to substantially 90 degrees, thereby placing tension and preloading on all three attachment points. Turning either adjustable attachment screw inclines the platform from its parallel relationship with the base plate. If a laser is inserted in the platform plate, the adjustable attachment points may be used to independently align the axis of the laser beam to any direction within the range of the threaded screws.

Other objects and advantages of the present invention will become more apparent during the course of the following description taken in connection with the accompanying drawings, wherein like numerals are employed to designate like parts. The accompanying drawings, which are incorporated in and constitute a part of the specification, illustrate an embodiment of the invention and, together with the description, serve to explain the principles of the invention.

DETAILED DESCRIPTION OF THE PREFERRED EMBODIMENTS

Reference will now be made in detail to a present preferred embodiment of the invention, an example of which is illustrated in the accompanying drawings.

Figure 1:
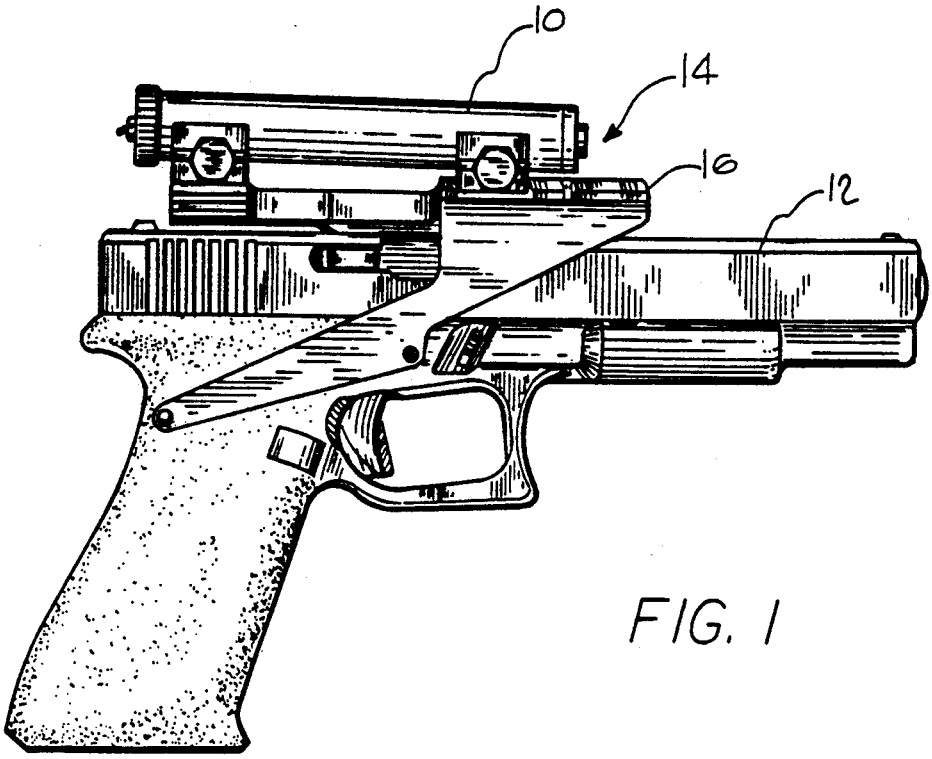
FIG. 1 is a side view of a laser sight apparatus of a preferred embodiment of the present invention mounted on a handgun.

A preferred embodiment of the laser alignment apparatus is illustrated by way of example in FIG. 1. In this preferred embodiment of the invention, the laser alignment apparatus is used in connection with laser sight 10 mounted to handgun 12.

Laser sight 10 is part of a sighting assembly 14 which includes a sight mount 16 physically connecting the laser sight 10 to the handgun 12. Additionally, the mount 16 may be used to make gross adjustments to the alignment of laser sight 10. The laser sight assembly 14 can be adapted for installation on almost any handgun 12 given the proper configuration of a sight mount 16 corresponding to a particular handgun 12, as is well known in the art.

Accordingly, in using handgun 12 after aligning the laser beam with the projectile's trajectory, as illustrated in FIG. 1, the shooter may achieve accurate aiming by activating laser sight 10 and positioning the resultant visible laser beam spot at the target and firing handgun 12. In order for there to be proper operation of the laser sighted handgun, there must be correct alignment of the laser beam for the corresponding target range.

Figure 2:
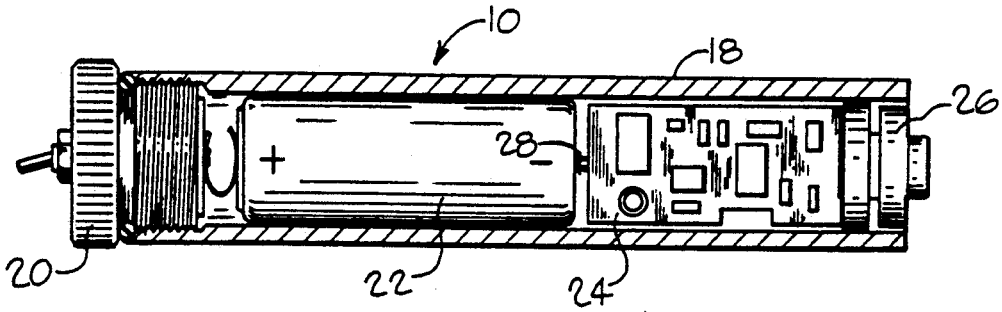
FIG. 2 is a cross sectional view of the laser sighting apparatus illustrated in FIG. 1.

A cross-section of laser sight 10 is illustrated in FIG. 2. Laser sight 10 includes laser sight housing 18, thumb-operable switch assembly 20, battery 22, control circuits 24, and laser alignment assembly 26. Laser sight housing 18 is preferably made of a light weight conductive metal such as aluminum. Housing 18 may be made of any suitable material to supply support and protection for the elements of laser sight 10.

Battery 22 is a commercially available 3 V to 6 V battery, such as a DL123 lithium battery manufactured by Duracell Inc., in the preferred embodiment. Battery 22 supplies power to control circuits 24.

Control circuits 24 are mounted on a printed circuit board assembly in the preferred embodiment. Discrete circuit elements, such as capacitors and resistors, are mounted onto the circuit board and metallization layers provide electrical connections between the circuit components. A circuit battery contact 28 supplies power from battery 22 to control circuits 24. Control circuits 24 are also electrically connected to elements of laser alignment assembly 26.

Figure 3:
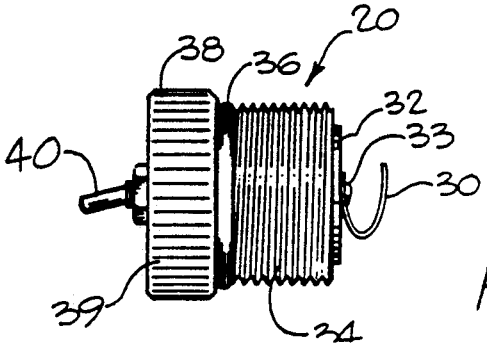
FIG. 3 is a side view of a switch of the laser sighting device illustrated in FIGS. 1 and 2.

FIG. 3 illustrates a thumb-operable switch assembly 20, preferably having an electrical contact 30, an insulating pad 32, threaded surface 34, an O-ring 36, a knurled outer end 38, and switch 40. The electrical contact 30 is attached through insulating pad 32 via an electrically conducting fastener 33. Electrically conducting fastener 33 is electrically coupled to one side of a two position switch 40. The other side of the switch 40 is electrically connected to threaded surface 34 which is connected through laser sight housing 18 which, in the preferred embodiment, is electrically conductive. The remaining electrical path is described further below. O-ring 36 provides environmental protection to threaded surface 34 and the interior of laser sight 10 by creating a hermetic seal.

Preferably, two-position switch 40 is mounted in conventional fashion to outer end 39. In the open position of switch 40, there is an open circuit between electrical contact 30 and a threaded surface 34. In the closed position of switch 40, the circuit between surface 34 and electrical contact 30 is completed. Conventional laser sighting devices for firearms commonly employ a contact switch which make electrical contact when a pressure is applied to the surface of the switch. Applicants have determined, however, that inopportune placement of a contact type switch may adversely affect sighting of the firearm because of the necessity of continually applying pressure against the switch to maintain the laser beam from the laser sight 10. Thus, addition of the two position switch 40 has been found to improve quick aiming of a firearm using the laser sight 10, and forms another aspect of the present invention.

Figure 4:
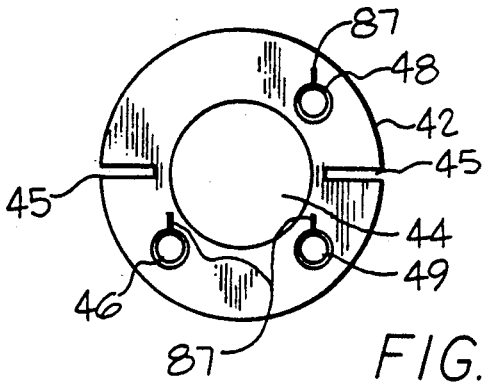
FIG. 4 is a top view of an embodiment of a base plate of a preferred embodiment of the invention as illustrated in FIGS. 1 and 2.
Figure 5B:
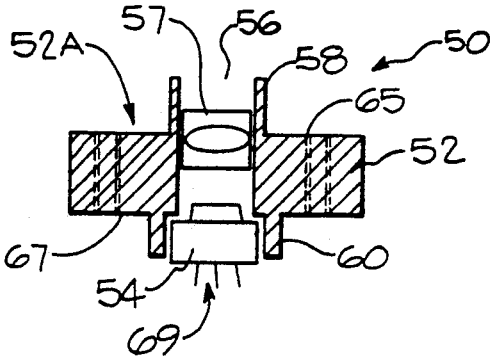
FIGS. 5A and 5B are a top view and cross sectional view of an embodiment of a platform of a preferred embodiment of the present invention as illustrated in FIGS. 1 and 2.
Figure 5A:
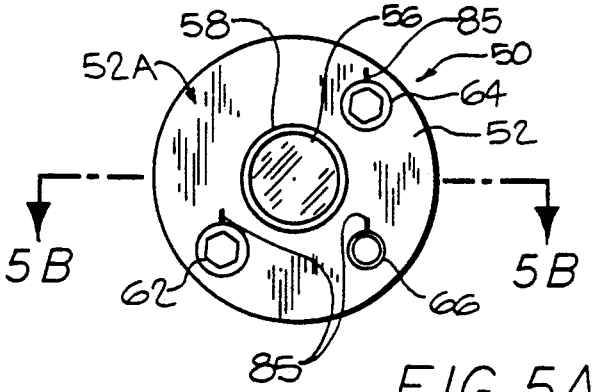

FIG. 4 shows base plate 42 of laser alignment assembly 26. Base plate 42 is preferably a plate having an annular configuration constructed so that its planar surfaces are substantially coextensive with the planar surfaces of platform 50, as shown in FIG. 5. Base plate 42 includes annular opening 44 which in the preferred embodiment is circular, having a common center with the outside circumference of base plate 42. The outside diameter of base plate 42 is preferably larger than the outside diameter of platform 52.

Other configurations and relative positioning of base plate 42 and platform 50 may be selected in order to practice the present invention. Alternative configurations and positions could be selected in accordance with the laser sight housing and other components selected. For example, base plate 42 and platform 52 may be constructed in a rectangular shape.

A first base plate adjustment opening or hole 46 and a second base plate adjustment opening or hole 48 are positioned along the surface of base plate 42. First base plate adjustment hole 46 and second base plate adjustment hole 48 are part of a structure for adjusting the angular orientation of the platform 50 relative to the base plate 42, in accordance with the invention. A base plate spacer hole 49 is also located within base plate 42 at substantially the same distance from the center of base plate interior opening 44 as base plate adjustment holes 46 and 48. Preferably, first base plate adjustment hole 46 and second base plate adjustment hole 48, are threaded with a thread having pitch $P_1$. Base plate spacer hole 49, however, is threaded in the preferred embodiment with a pitch $P_3$. Thread pitches and screw diameters are defined, according to well known industry standards, by a three digit code wherein the first digit designates a standard screw diameter followed by a dash and the second two digits are a designation of threads per lineal inch. Preferably, $P_1$ and $P_3$ are designated as screw diameters and pitches 2–56 and 0–80, respectively.

Notches 45 are positioned along the circumference of base plate 42, extending in toward the center. In a preferred embodiment, notches 45 physically secure control circuits 24 to base plate 42.

FIG. 5 illustrates platform assembly 50, which includes platform 52, laser assembly 54 and lens assembly 57. Platform 52 may be made of the same material as base plate 42, and is substantially coextensive with base plate 42 in a preferred embodiment of the present invention. In the preferred embodiment base plate 42 and platform 50 are made of an electrically conductive and thermally conductive material such as aluminum. The thermal conductivity assists in cooling the laser element.

Platform 52 is an annular plate having an interior opening 56 which in the presently-preferred embodiment is a concentric circular opening, having a common center to the circumference of platform 52. An annular lip 58 extends up from base plate 52 in the preferred embodiment, as illustrated in FIG. 5B. Lens assembly 57 is installed in opening 56 in order to collimate a normally divergent beam produced by laser assembly 54. A second annular lip 60 extends downwardly from platform 52. Annular lip 60 provides an attachment for laser assembly 54 to platform 52. That is, laser assembly 54 is affixed to platform assembly 50 via attachment to annular lip 60. The contact between laser assembly 54 and platform 52 provide a portion of the electrical path between control circuit 24 and the positive terminal of battery 22. As discussed above housing 18 provides another portion of this electrical path, extending from battery 22 through switch assembly 20. In the preferred embodiment the electrical path continues from housing 18 through base plate 48 and screws 68, 76 to platform 52. From platform 52 the electrical path continues through the outer surface of laser assembly 54 to control circuit 24 via one of leads 69 from the laser. In diode laser assemblies commonly available, one of leads 69 is connected to the outer surface of laser assembly 54. One such laser is TOLD 9211 available from Toshiba Corporation. Of course, alternative electrical paths could be chosen without departing from the spirit of the present invention.

Figure 11:
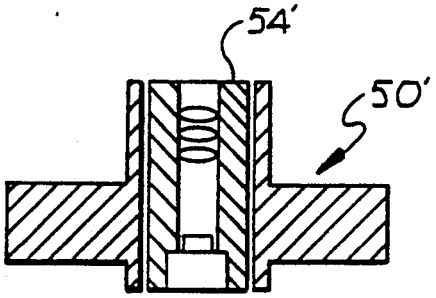
FIG. 11 is a cross sectional view of an alternate embodiment of the present invention.

Other conventional means of attachment for laser assembly 54 may also be selected in accordance with the present invention. By way of example, FIG. 11 shows laser assembly 54' having an integral lens attached within opening 56 through lip 60 and lip 58. In general, lip 58 and 60 facilitate a compact construction within the cylindrical housing 18. In applications where size is not a consideration, however, lip 58 and 60 need not be included in the structure of platform 52.

Either of laser assemblies 54 or 54' can be any type of conventional laser. In the preferred embodiment of the invention intended for firearm sighting applications, the laser is a rugged semiconductor type laser (not shown), mounted within a housing. Alternative types of laser assemblies may be used such as, for example, a diode laser having a collimating lens assembly mounted within laser assembly 54' as shown in FIG. 11.

Platform 52 includes a first platform adjustment hole 62, a second platform adjustment hole 64 (shown with adjustment screws installed), and a platform spacer hole 66, which are aligned with first base plate adjustment hole 46, second base plate adjustment hole 48, and base plate spacer hole 49, respectively, when base plate 42 and platform 52 are aligned in a planar relationship. Preferably, base plate interior opening 44 is large enough to accommodate movement of platform assembly annular lip 60 containing laser assembly 54.

First platform adjustment hole 62 and second platform adjustment hole 64 are threaded with a pitch $P_2$, which is different from pitch $P_1$. In the presently preferred embodiment, thread pitch $P_2$ is less than thread pitch $P_1$ (in other words $P_2$ has fewer threads per unit length than $P_1$) and, together with the hole diameter, is given a value of 4–40 according to well known industry standards. Platform spacer hole 66 is threaded with the same pitch $P_3$ as base plate spacer hole 49, in the preferred embodiment this hole diameter and pitch is 0–80.

Figure 6A:
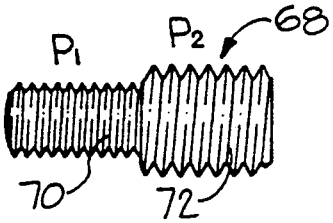
FIGS. 6A and 6B are a side view and an end view, respectively, of an adjustment screw for the base plate and platform of FIGS. 4 and 5, respectively.
Figure 6B:
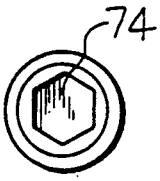
Figure 7A:
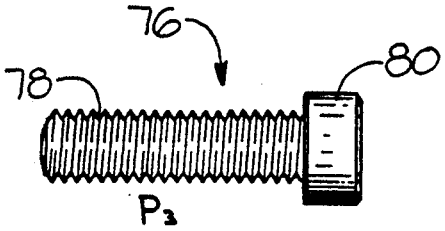
FIGS. 7A and 7B are a side view and an end view, respectively, of a spacer screw for the base plate and platform of FIGS. 4 and 5, respectively.

The screws used to attach base plate 42 and platform assembly 50 are illustrated in FIGS. 6 and 7. When platform assembly 50 is connected to base plate 42, platform assembly 50 may be angled with respect to base plate 42 by utilization of screws through respective holes in base plate 42 and platform 52. Base plate 42 is rigidly mounted to the reference or, in the case of the present preferred embodiment, to laser sight 10, which is mounted on sight mount 16 the resulting laser sight assembly 14 is mounted then to handgun 12. Thus, in the preferred embodiment, handgun 12 can be considered as the reference.

Figure 10:
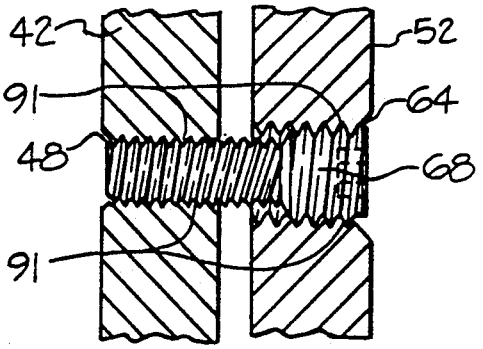
FIG. 10 is a cross sectional view of a portion of the base plate and platform of FIG. 9 with an adjustable attachment installed.

FIGS. 6A and 6B illustrate an adjustment screw 68 one of which engages first platform adjustment hole 62 and another of which engages second platform adjustment hole 64. Adjustment screw 68 consists of two portions. A first threaded portion 70 is threaded with pitch $P_1$ corresponding to the pitch of the threads of the first and second base plate adjustment holes 46 and 48 and a second portion 72 is threaded with a second pitch $P_2$ corresponding to the threads of first and second platform adjustment holes 62 and 64. Threaded machine screws of this type are known as differential threaded screws and are well known in the art of machine screws. Adjustment screw 68 is adjusted in the preferred embodiment by means of a hexagonal inset 74, as illustrated in FIG. 6B. In the preferred embodiment a viscous compound 91 (as shown in FIG. 10) resistant to motion at various frequencies is applied along threaded portions 70 and 72 of adjustment screws 68 to secure screws 68 in the respective adjustment holes 46, 48 and 62, 64. One such compound is VIBROSIDE (a trademark) from Locktite Corp.

Figure 7B:
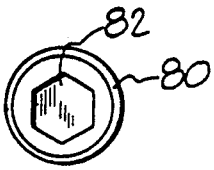

FIG. 7 illustrates a spacer screw 76 having a threaded portion 78 and a head portion 80. Threaded portion 78 is threaded with a pitch $P_3$ which corresponds to the pitch of the threaded portion of both base plate spacer hole 49 and platform spacer hole 66. Preferably, though not necessarily a hexagonal insert 82 is provided at head portion 80 for securing of spacer screw 76, as illustrated in FIG. 7B. Preferably, screw 76 has a diameter sufficient to allow bending and is preferably made of a tensile material such as stainless steel or annealed beryllium-copper.

Spacer screw 76 is threaded, in the preferred embodiment, into the platform hole 66 through surface 65 (see FIG. 5B), the screw is threaded into the hole 66 an amount such that a predetermined amount of spacer screw 76 extends beyond surface 67 of platform 52. This predetermined amount constitutes the spacing that will exist between the platform and the base plate 42. Base plate 42 is then brought into position and spacer screw 76 is threaded further into hole 66 in platform 52 and simultaneously into hole 49 in base plate 42 until head 80 is brought in contact with surface 65 and tightened. In the preferred embodiment of the invention a seizing compound such as ASSURE (a trademark) of Locktite Corporation is applied between spacer screw 76 and threaded holes 49 and 66 to secure spacer screw 76 to platform 52 and base plate 42.

Other embodiments could have the spacer screw replaced by a dowel pin where holes 66 and 49 are drilled but not tapped and the dowel pin is pressed into position. Alternatively, spacer screw 76 could have a larger threaded diameter and be of a nontensile material. Holes 49 and 66 would then preferably be threaded with a tolerance to allow spacer screw 76 to pivot within the holes 49 and 66 about a small angle, thus allowing adjustment of platform 52 with respect to baseplate 42.

Figure 8:
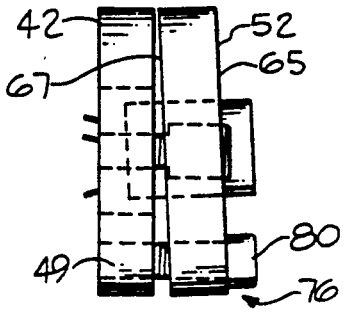
FIG. 8 is a side view of the base plate and platform in the position of normal operation of FIGS. 4 and 5, respectively.

FIG. 8 illustrates the angle of inclination of platform spacer hole 66 through platform 52 in the preferred embodiment. When neither adjustment screw 68 is inserted within laser alignment assembly 26 and spacer screw 76 is inserted through platform spacer hole 66 and base plate spacer hole 49, the two plates are angled as shown in FIG. 8 due to the angle of inclination of platform spacer hole 66 in the preferred embodiment. Platform spacer hole 66 is angled at an angle approximately 3-5 degrees from a normal to the plane of platform 52 out from the center of platform 52.

Figure 9:
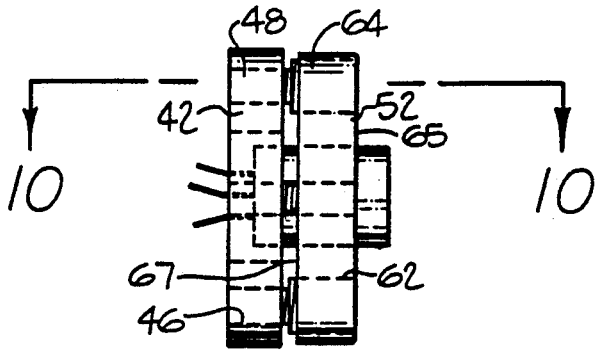
FIG. 9 is a side view of the base plate and platform of FIGS. 4 and 5, respectively, in position prior to installation of the adjustable attachments.

After the insertion of an adjustment screw 68 through first platform adjustment hole 62 and first base plate adjustment hole 46 and another adjustment screw 68 through second platform adjustment hole 64 and second base plate adjustment hole 48, base plate 42 and platform 52 may be aligned parallel to each other, as illustrated in FIG. 9. Thus, spacer screw 76, in combination with angled platform spacer hole-66, provides tension against which the two adjustment screws 68 push. Angular alignment of the axis of the laser and laser assembly 54 is accomplished by turning adjustable screws 68 within the respective adjustment holes of base plate 42 and platform 52. To reduce inadvertent potential relative movement of the adjustment screws 68 with respect to base plate 42 and platform 52, a viscous fluid is applied to the threaded portions 70 and 72 of these screws.

FIG. 10 shows a detailed illustration of the adjustment screw 68 positioned through second base plate adjustment hole 48 and second platform adjustment hole 64. The respective adjustable screws 68 are turned using a hex head tool matching hex head inset 74 until the axis of the laser is normal to the plane of base plate 42, or until some other desired direction of the laser is achieved. This alignment action is achieved by the differential action of the two thread pitches $P_1$ and $P_2$ of adjustable screws 68. As adjustable screw 68 is turned clockwise, the progress of adjustable screw 68 into base plate 42 is slower than the progress into platform 52, given that thread pitch $P_2$ is less (has a coarser thread) than thread pitch $P_1$ in a preferred embodiment. The corresponding increase in separation of base plate 42 and platform 52 at a particular adjustment point is given by the expression:

$$s = t \times (1/p_2 - 1/p_1),$$

where t is the number of turns of screw 68 and s is the separation distance in inches. $P_1$ and $P_2$ are the respective pitches given in threads per inch.

A change in separation s caused by adjustment of a particular adjustment screw 68 results in platform 52 tilting relative to base plate 42 by an angular amount a given by the expression:

$a = \tan^{-1} s/d \approx s/d$ (small angle approximation)

where d is the distance between the center of the adjustment hole and the center of the spacer hole, which could be, for example, the distance between platform adjustment hole 64 and platform spacer hole 66. Therefore, the range of adjustment of alignment angle a is limited by the distance d between the holes, and the separation when base plate 42 and platform 52 are parallel, which is determined by the setting of spacer screw 76. The relative adjustment angles provided by the two adjustment means actuated by adjustment screws 68 placed through respective pairs of adjustment holes are orthogonal and independent due to the right angle formed between lines drawn from the two adjustment holes to the spacer hole in each of the base plate 42 and platform 52 in the preferred embodiment of invention.

It will be apparent to those skilled in the art that various modifications and variations can be made in the laser alignment apparatus of the present invention, without departing from the scope or spirit of the invention. For example a commercial switch assembly may also be employed to energize the laser without departing from the present invention. Thus, it is intended that the present invention cover the modifications and variations of this invention, provided they come within the scope of the appended claims and their legally permissible equivalents.

We claim:

1. A laser alignment apparatus for aligning an angle of a laser relative to a laser mount which attaches to a firearm, said laser alignment apparatus comprising:

a laser element;

a housing for the alignment apparatus;

a base plate, coupled to said housing, having an inner opening with an annular configuration for allowing movement of said laser element within said base plate;

a platform having an inner opening with an annular configuration substantially coextensive with the inner opening of said base plate and means for attaching said laser element to said platform;

a spacer attachment means for holding said base plate and platform together and for facilitating relative spacing therebetween; and a first adjustment means and a second adjustment for adjusting said platform relative to said base plate, said spacer means is located in said base plate such that an angel between a line between said spacer means and said first adjustment means and a line between said spacer means and said second adjustment means is a right angle.

2. A laser alignment apparatus according to claim 1 wherein said first adjustment means includes a first threaded adjustment opening through said base plate, a first threaded adjustment opening through said platform, both of said adjustment openings being aligned and a first threaded adjustment screw, and wherein said second adjustment means includes a second threaded adjustment opening through said base plate, a second threaded adjustment opening through said platform both of said adjustment openings being aligned, and a second threaded adjustment screw.

3. A laser alignment apparatus according to claim 2 wherein said first and second threaded adjustment openings through said base plate have a first thread pitch and said first and second threaded adjustment openings through said platform have a second thread pitch, said first and second thread pitches being different.

4. A laser alignment apparatus according to claim 3 wherein said first and second threaded adjustment screw each have a first portion threaded with said first pitch and a second portion threaded with said second pitch.

5. A laser alignment apparatus according to claim 1 wherein said spacer means includes a threaded screw and respective spacer openings through said base plate and said platform, both of said spacer openings being aligned and threaded to accommodate said threaded screw.

6. A laser alignment apparatus according to claim 5 wherein at least one of said relative spacer openings is angled through at least one of said platform and base plate at a nonzero angle of inclination with respect to a line parallel to an annular axis of at least one of said platform and base plate.

7. A laser alignment apparatus according to claim 5 wherein said spacer adjustment screw is a non-tensile material and tolerances between said base and platform spacer openings provide pivoting about a small angle between said screw and said openings.

8. A laser alignment apparatus according to claim 1 wherein said laser assembly includes a two position switch.

9. A laser alignment apparatus according to claim 1 wherein said base plate, platform and spacer attachment means are thermally conducting.

10. A laser alignment apparatus according to claim 1 wherein said base plate, platform and at least one of said adjustment means are thermally conducting.

11. A laser alignment apparatus according to claim 1 wherein said base plate platform and spacer attachment means are electrically conducting.

12. A laser alignment apparatus according to claim 1 wherein said base plate platform and at least one of said adjustment means are electrically conducting.

13. A laser alignment apparatus for aligning an angle of a laser relative to a laser mount which attaches the laser to a firearm, said laser alignment apparatus comprising:

a laser element;

a base plate coupled to the laser mount;

a platform having said laser element attached;

first adjustment means and second adjustment means for adjusting said platform relative to said base plate;

said first adjustment means including a first threaded adjustment opening through said base plate, a first threaded adjustment opening through said platform, both of said first adjustment openings being aligned, and a first threaded adjustment screw;

said second adjustment means includes a second threaded adjustment opening through said base plate, a second threaded adjustment opening through said platform, both of said second adjustment openings being aligned and a second threaded adjustment screw; and said first and second threaded adjustment openings through said base plate have a first thread pitch and said first and second threaded adjustment openings through said platform have a second thread pitch, said first and second thread pitches being different.

14. A laser alignment apparatus according to claim 13 further comprising spacer means for facilitating relative spacing between said base plate and platform, located in said base plate such that an angle between a line between said spacer means and said first adjustment means and a line between said spacer means and said second adjustment means is approximately a right angle.

15. A laser alignment apparatus according to claim 14 wherein said spacer means includes a threaded spacer screw and respective spacer openings through said base plate and said platform and wherein said threaded spacer screw is a non-tensile material and tolerances between said respective spacer openings provide pivoting about a small angle between said spacer screw and said respective spacer openings.

16. A laser alignment apparatus according to claim 13 further comprising a threaded spacer screw engaging respective spacer openings through said base plate and said platform, and wherein at lease one of said respective spacer openings through one of said platform and base plate is at a non-zero angle of inclination with respect to an annular axis of said platform.

17. A laser alignment apparatus according to claim 13 wherein said laser assembly includes a two position switch.

18. A laser aiming apparatus for a firearm, comprising:

a laser housing;

a base plate disposed within and attached to the housing;

a platform disposed within the housing adjacent the base plate;

a lasing element attached to the platform;

spacer means for retaining the platform adjacent the base plate;

a first and second adjustment screw threadingly engaging the platform with first thread pitches and engaging the base plate with second thread pitches differing from said first pitches, wherein rotation of the first or second screw reorients the platform and lasing element with respect to the laser housing.

19. The laser aiming apparatus of claim 18 wherein the lasing element is electrically connected to a two position switch attached to the laser housing.

20. The laser aiming apparatus of claim 18 wherein lines drawn from each of the first and second adjustment screws to the spacer means form an approximate right angle.

21. The laser aiming apparatus of claim 18, wherein the spacer means is a screw threadingly engaging the platform and threadingly engaging the base plate at a non-perpendicular angle with respect to an annular axis of the base plate.

22. The laser apparatus of claim 21 wherein the spacer means screw threadingly engages the base plate at an angle approximately three to five degrees off axis from said annular axis of the base plate.

23. The laser aiming apparatus of claim 21 wherein the spacer means screw is a non-tensile material and wherein tolerances between threaded apertures in the base plate and platform engaging said spacer means screw provide small angle pivoting between said spacer means screw and said apertures.

24. The aiming laser of claim 18 wherein the first thread pitches of both said first and second adjustment screws are a 4–40 pitch and wherein the second thread pitches of both said first and second adjustment screws are a 2–56 pitch.

25. The laser aiming apparatus of claim 18 wherein the spacer means is a screw threadingly engaging the base plate and threadingly engaging the platform at a non-perpendicular angle with respect to an annular axis of the platform.

26. The laser aiming apparatus of claim 25 wherein the spacer means screw threadingly engages the platform at an angle approximately three to five degrees off axis from said annular axis of the platform.

27. A laser aiming apparatus for a firearm, comprising:

a base plate attached to an apparatus housing;

a platform disposed adjacent the base plate;

a lasing element coupled to the platform;

pivoting means for facilitating relative pivoting between the platform and the base plate;

first adjustment means for adjusting the orientation of the platform with respect to the base late along a first pivot axis; and second adjustment means for adjusting the orientation of the platform with respect to the base plate along a second pivot axis, said first and second adjustment means being located so that a line from said first adjustment means to said pivoting means is approximately perpendicular to a line from said second adjustment means to said pivoting means.

28. The laser alignment apparatus of claim 27 wherein said first and second adjustment means are screws threadingly engaging said platform with a first thread pitch and threadingly engaging said base plate with a differing second thread pitch.

29. The laser alignment apparatus of claim 28 wherein said pivoting means is a screw threadingly engaging said base plate and platform so as to orient the base plate in non-parallel relation to the platform.

30. The laser aiming apparatus of claim 29 wherein said pivoting means screw threadingly engages at least one of said base plate and platform at an angle 3–5 degrees off parallel to an annular axis of at least one of said base plate and platform.

31. The laser aiming apparatus of claim 30 wherein said pivoting means screw is a non-tensile material and tolerances between threaded apertures in said base plate and platform engaging said pivoting means screw provide pivoting about a small angle between said pivoting means screw and said threaded apertures.

32. A laser aiming device for a firearm comprising:

a device housing;

a base plate coupled to the housing;

a platform disposed adjacent the base plate;

a lasing element coupled to the platform and first and second adjustment screws respectively threadingly engaging the base plate with a first thread pitch and the platform with a second thread pitch, wherein rotation of either the first or second adjustment screw alters an orientation of the platform with respect to the base plate.

33. The laser aiming device of claim 32 further comprising pivoting means for facilitating pivoting of the platform with respect to the base plate and disposed between said platform and baseplate so that a line from said first adjustment screw to said pivoting means is approximately perpendicular to a line from said second adjustment screw to said pivoting means.

34. The laser aiming device of claim 33 wherein said pivoting means further includes means for biasing said base plate with respect to said platform.

35. The laser aiming device of claim 33 wherein said pivoting means is a screw threadingly engaging the base plate and platform.

36. The laser aiming device of claim 35 wherein said pivoting means screw threadingly engages at least one of the base plate and the platform so as to orient the base plate in a non-parallel orientation to the platform.

37. The laser aiming apparatus of claim 36 wherein said pivoting means screw is a non-tensile material and tolerances between threaded apertures in said base plate and platform engaging said pivoting means screw provide pivoting about a small angle between said pivoting means screw and said threaded apertures.

38. The laser aiming device of claim 36 wherein said pivoting means screw threadingly engages at least one of the base plate and platform at an angle of about three to five degrees off axis to an annular axis of at least one of the base plate and platform.

39. A laser alignment apparatus for aligning a laser mounted to a fire arm comprising:

an apparatus housing;

a base plate coupled to the housing;

a platform disposed adjacent the base plate;

a lasing element coupled to the platform;

spacer means for maintaining a relative spacing between the base plate and the platform; and first and second adjustment screws respectively engaging the platform with a first thread pitch and the base plate with a differing second thread pitch, said first and second adjustment screws being positioned so that a line from said first adjustment screw to said spacer means is at approximately right angle to a line from said second adjustment screw to said spacer means, wherein rotation of the first adjustment screw pivots the platform with respect to the base plate about a first axis and rotation of the second adjustment screw pivots the platform with respect to the base plate about a second axis.

40. The laser apparatus of claim 39 wherein said spacer means further includes means for biasing said base plate with respect to said platform in a non-parallel orientation.

41. The laser apparatus of claim 39 wherein said spacer means is a screw threadingly engaging said base plate and platform.

42. A laser alignment apparatus for aligning an angle of a laser relative to a laser mount which attaches the laser to a reference, said laser alignment apparatus comprising:

a lasing element;

a housing for the laser element;

a base plate, coupled to the housing, having an inner opening with an annular configuration for allowing movement of said laser element within said base plate;

a platform having an inner opening with an annular configuration substantially coextensive with the inner opening of said base plate and means for attaching said laser element to said platform;

a spacer means for facilitating relative pivoting between said base plate and platform, including a threaded screw and relative spacer openings through said base plate and said platform, both said spacer openings being aligned and threaded to accommodate said threaded screw;

a first adjustment means and a second adjustment means for adjusting said platform relative to said base plate.

43. A laser alignment apparatus according to claim 42 wherein said spacer opening is angled through at least one of said platform and base plate at a non zero angle of inclination with respect to a line parallel to an annular axis of at least one of said platform and base plate.

44. The laser alignment apparatus of claim 42 wherein said first and second adjustment means are screws threadingly engaging said platform with a first thread pitch and threadingly engaging said base plate with a differing second thread pitch.

45. A laser alignment apparatus for aligning an angle of a laser relative to a laser mount which attaches a laser to a firearm, said laser alignment apparatus comprising:

a housing for the alignment apparatus;

a laser element disposed within said housing;

a base plate, coupled to said housing, having an inner opening with an annular configuration for allowing movement of said laser element within said base plate;

a platform having an inner opening with an annular configuration substantially coextensive with the inner opening of said base plate and means for attaching said laser element to said platform;

a spacer means for facilitating relative spacing between said base plate and platform;

first adjustment means for adjusting said platform relative to said base plate, including a first threaded adjustment opening through said base plate, a first threaded adjustment opening through said platform, both of said adjustment openings being aligned, and a first threaded adjustment screw; and a second adjustment means for adjusting said platform relative to said base plate including a second threaded adjustment opening through said base plate, and a second threaded adjustment opening through said platform, both of said adjustment openings being aligned, and a second threaded adjustment screw.

46. The laser alignment apparatus according to claim 45 wherein said first and second threaded adjustment openings through said base plate have a first thread pitch and said first and second threaded adjustment openings through said platform have a second thread pitch, said first and second thread pitches being different.

47. The alignment apparatus of claim 45 wherein said spacer means further includes means for biasing said base plate with respect to said platform in a non-parallel orientation.

48. The alignment apparatus of claim 45 wherein said spacer means is a screw threadingly engaging said base plate and platform.

49. The alignment apparatus of claim 45 wherein said spacer means screw threadingly engages at least one of the base plate and the platform so as to orient the base plate in a non-parallel orientation to the platform.

50. The alignment apparatus of claim 49 wherein said spacer means screw is a non-tensile material and tolerances between threaded apertures in said base plate and platform engaging said spacer means screw provide pivoting about a small angle between said spacer means screw and said threaded apertures.

51. The aiming apparatus of claim 49 wherein said spacer means screw threadingly engages at least one of the base plate and platform at an angle of about three to five degrees off axis to an annular axis of at least one of the base plate and platform.

* * * * *